US009296536B2

(12) United States Patent
Haering et al.

(10) Patent No.: US 9,296,536 B2
(45) Date of Patent: Mar. 29, 2016

(54) MULTIPLE BLISTER PACK FOR BUTTON BATTERIES

(71) Applicant: Renata AG, Itingen (CH)

(72) Inventors: Pascal Haering, Aesch (CH); Eric Weber, Gelterkinden (CH)

(73) Assignee: Renata AG, Itingen (CH)

( * ) Notice: Subject to any disclaimer, the term of this patent is extended or adjusted under 35 U.S.C. 154(b) by 51 days.

(21) Appl. No.: 13/712,250

(22) Filed: Dec. 12, 2012

(65) Prior Publication Data

US 2013/0161231 A1 Jun. 27, 2013

(30) Foreign Application Priority Data

Dec. 22, 2011 (EP) ..... 11195329

(51) Int. Cl.
*B65D 85/00* (2006.01)
*B65D 75/36* (2006.01)
*B65B 5/02* (2006.01)

(52) U.S. Cl.
CPC ..... *B65D 75/367* (2013.01); *B65B 5/02* (2013.01); *B65D 2585/88* (2013.01)

(58) Field of Classification Search
CPC ..... B65D 2575/365; B65D 2575/3236; B65D 2575/3227; B65D 75/327; B65D 75/367; B65D 2585/88; B65D 75/368; B65B 5/02
USPC ..... 206/704, 703, 528, 531, 532, 538, 484, 206/461, 462, 463, 755, 470, 705, 467, 471, 206/443, 751, 759, 747, 745, 508, 499; 53/542
See application file for complete search history.

(56) References Cited

U.S. PATENT DOCUMENTS 2,984,346 A 5/1961 Holley
3,743,084 A * 7/1973 Douglas ..... 206/532
(Continued)

FOREIGN PATENT DOCUMENTS

WO WO 01/68472 A1 9/2001
WO WO 2010/142587 A1 12/2010

OTHER PUBLICATIONS

European Search Report issued Apr. 27, 2012 in corresponding European Application No. 11 19 5329 filed on Dec. 22, 2011.
(Continued)

*Primary Examiner* — Anthony Stashick
*Assistant Examiner* — James M Van Buskirk
(74) *Attorney, Agent, or Firm* — Oblon, McClelland, Maier & Neustadt, L.L.P

(57) ABSTRACT

Multiple blister pack (1) for button batteries comprising a blister foil (10) designed to provide individual storage cups (12) of center (C) and diameter (D) for receiving a button battery, and individual closure regions (13) for each said individual storage cup (12). Each closure region (13) receives a closure element (4), and the individual storage cups (12) are arranged on the blister foil (10) according to a matrix pattern with at least two columns. Each closure region (13) surrounding each individual storage cup (12) are mutually separated by column and row tearing lines (2,2'). The closure element (4) and/or the closure region (13) is provided with tracking information concerning the battery stored in said individual storage cup (12) and the centers (C) of the individual storage cups (12) are spaced apart of a distance equal to twice the diameter (2*D) of the individual storage cup (12) from each other along each column of said matrix, within a tolerance of 1 millimeter.

9 Claims, 3 Drawing Sheets

(56) References Cited

U.S. PATENT DOCUMENTS

| | | | | |
|---|---|---|---|---|
| 4,387,809 | A * | 6/1983 | Botzler | 206/526 |
| 5,033,616 | A | 7/1991 | Wyser | |
| 5,046,618 | A * | 9/1991 | Wood | 206/532 |
| 5,358,118 | A * | 10/1994 | Thompson et al. | 206/538 |
| 6,659,281 | B2 * | 12/2003 | Gaffney et al. | 206/704 |
| 6,802,422 | B2 * | 10/2004 | Kalvelage et al. | 206/538 |
| 6,830,153 | B2 * | 12/2004 | French et al. | 206/538 |
| 7,410,059 | B2 * | 8/2008 | Nakatsu et al. | 206/704 |
| 7,451,876 | B2 * | 11/2008 | Bossi et al. | 206/534 |
| 7,780,009 | B2 * | 8/2010 | Casanova | 206/705 |
| 8,006,834 | B2 * | 8/2011 | Marcinkowski | 206/232 |
| 8,247,892 | B2 * | 8/2012 | Staroveck | 257/678 |
| 2005/0109658 | A1 * | 5/2005 | Bindford | 206/534 |
| 2008/0032191 | A1 * | 2/2008 | Kennedy et al. | 429/185 |
| 2011/0177217 | A1 * | 7/2011 | Chait et al. | 426/248 |
| 2012/0080353 | A1 | 4/2012 | Brenner | |

OTHER PUBLICATIONS

U.S. Appl. No. 13/712,216, filed Dec. 12, 2012, Haering, et al.

* cited by examiner

MULTIPLE BLISTER PACK FOR BUTTON BATTERIES

This application claims priority from European Patent Application No. 11195329.5 filed Dec. 22, 2011, the entire disclosure of which is incorporated herein by reference.

TECHNICAL DOMAIN

The present invention relates to a blister pack for button batteries, and especially for multiple packs with individual compartments.

PRIOR ART

It is well known to market batteries in multiple arrangements in blister packs. Such packs are usually based on a cardboard piece with a one-sided coating and, placed on top, a transparent plastic film with thermoformed receiving spaces for spaced-apart button batteries. The front and rear side of the cardboard can be used for advertising, dating or providing information on the contents or on instructions for use. This type of packaging is also available for button batteries, wherein individual batteries are preferably released from the pack by pressing through a zonal section of the cardboard piece bounded by tearing lines, whereas unused batteries remain fixed on the cardboard until their removal.

A disadvantage of this solution is that the cardboard is relatively thick in order to keep the pack secure, so that the opening of the battery compartment requires relatively great force. Moreover, inadequately pre-imprinted tearing lines may result in adjacent areas of the cardboard piece to be torn out undesirably, so that the remaining batteries stored in the pack may drop out.

Another type of multiple blister packs is known for button batteries, which is similar to the one used for pharmaceutical pills, i.e. wherein a thermoformed plastic film defining individual cups for receiving the items is usually sealed by a thin metal film containing a bar code. Yet as opposed to the blister packs of the pharmaceutical industry, the cups are not arranged according to an array pattern with multiple rows due to the size of the bar code which takes the whole width of the closure regions surrounding the cup. Each compartment is separated from each other by a rectilinear tearing line, so that a subset of individual pills can be detached for nomadic use, and the batteries are extracted by pressing on the reverse side of the cups until the closure film is torn down and lets the items through for removal.

Although this latter type of blister packaging allows for an easier opening of the cups and provides a more reliable modular removal scheme for each stored item, i.e. without dropping out any other battery of the pack, yet it is still very voluminous and therefore not suited for a compact storage of a given number of batteries. Moreover, so far there is no way to reliably track each single battery, but only the cups in which they are individually stored through the bar codes.

There is therefore a need for a multiple blister pack exempt from the known limitations of the prior art.

BRIEF SUMMARY OF THE INVENTION

It is a goal of the present invention to provide a multiple blister pack for button batteries with more efficient storage capacity.

It is another goal of the present invention is to provide a blister pack for button batteries which can not only be freely portioned, but also hung for selling purposes, and provides a reliable tracking of each battery stored in the pack.

These goals are achieved especially thanks to the features of independent claim 1, i.e. a multiple blister pack for button batteries comprising a blister foil 10 designed to provide individual storage cups of center C and diameter D for receiving a button battery, and individual closure regions for each individual storage cup, wherein each closure region receives a closure element. The individual storage cups are arranged on the blister foil according to a matrix pattern with at least two columns, wherein each closure region surrounding each individual storage cup are mutually separated by column and row tearing lines. The closure element and/or the closure region is provided with tracking information concerning the battery stored in the individual storage cups and the centers C of said individual storage cups are spaced apart of a distance equal to twice the diameter (2*D) of the individual storage cups from each other along each column of the matrix, within a tolerance of 1 millimeter.

These goals are also achieved by a method for storing button batteries into a multiple blister pack comprising the following steps:

- marking button batteries with respective tracking information;
- thermoforming a blister foil so as to provide a matrix of individual storage cups of center (C) and diameter (D) for receiving each a button battery, wherein the matrix comprises at least two rows and the centers (C) of said individual storage cups are spaced apart of a distance equal to twice the diameter (2*D) of said individual storage cup from each other along each column of said matrix, within a tolerance of 1 millimeter;
- placing the button batteries into individual storage cups;
- bonding closure elements on closure regions surrounding the individual storage cups;
- realizing column and row tearing lines around each closure region surrounding each individual storage cup;
- marking each said closure elements and/or the closure regions with the respective tracking information of the button batteries.

Advantageous embodiments are recited in the dependent claims.

An advantage of the blister pack according to the present invention is that is allows for a stacking of the multiple pack of reduced height for a given number of batteries to store, so that blister packs can be grouped in boxes of a reduced volume for shipment.

Another advantage of the proposed blister pack is that it provides a dedicated tracking scheme of each battery of the pack, which was hitherto impossible.

BRIEF DESCRIPTION OF THE DRAWINGS

Examples of preferred embodiments of the invention are described in the detailed description hereafter in view of the following drawings in which.

DETAILED DESCRIPTION OF THE INVENTION

Figure 1A:
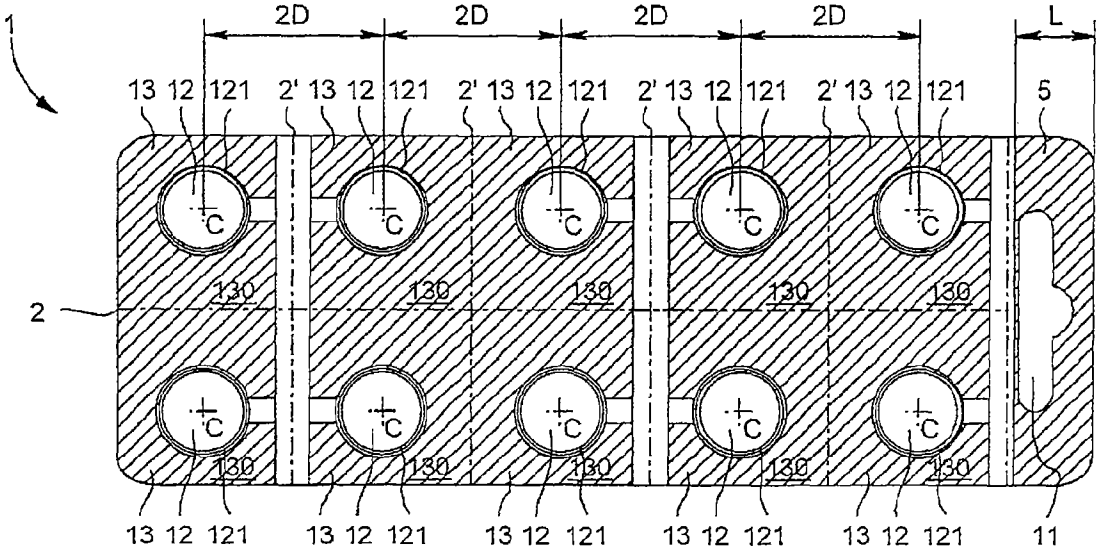
FIGS. 1A and 1B show a multiple blister pack according to a preferred embodiment of the invention, arranged in a set of 2 columns and 5 rows, respectively from to a rear and side view.

FIGS. 1A and B show a blister pack for button batteries according to a preferred embodiment for the invention, wherein an array of 5*2 of storage cups 12 is formed in a blister foil 10 shown in a dashed pattern. In order to provide the matrix of individual storage cups 12 for receiving the button batteries, a blister foil 10, e.g. a plastic film whose thickness is preferably comprised within 0.1-0.3 millimeters, is preferably thermoformed in order to provide individual storage cups 12 whose diameter D is preferably comprised within 5 and 13.5 millimeters for storing button batteries whose diameter usually ranges between 4.8 and 11.6 depending on their standard. As it can be appreciated in view of FIG. 1B, the thermoforming process yields compartments of a given height H, typically 4 to 5 millimeters, and raises lateral walls 122, wherein the bottom 120 has a slightly smaller diameter due to the inclination of the lateral walls 122 with respect to the vertical direction. Due to the slight difference between the diameter of the bottom 120 and the diameter D of the storage cups 120 at the blister foil 10 level, on FIG. 1A the edges 121 of each storage cup 120 are illustrated with a bold line.

As it can be seen on FIG. 1A, the centers C of each storage cup 12 are marked as well as their respective distance between each other, equal to twice the diameter (2*D) of each storage cup, within an error margin of less than one millimeter for the diameter size mentioned hereinbefore used for usual button batteries. Such a distance arrangement between each storage cup 12 allows to stack two multiple packs 1 onto each other in dividing the overall storage space by 2, as will be explained later on especially in view of FIGS. 4A to 4C, while the relatively low margin of error of 1 millimeter is foreseen in order to limit the mutual lateral movement of two adjacent multiple blister packs, which could result in unwanted shaking movement inside a shipment box, and also to facilitate the insertion and interlocking of adjacent storage cup 12 of two facing multiple blister packs 1.

Figure 1B:
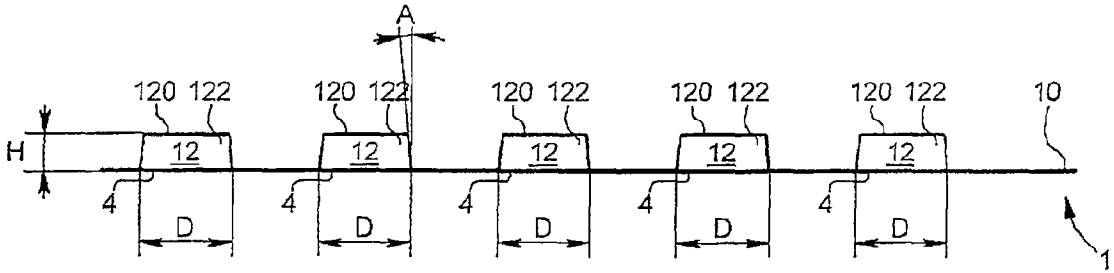

As it can be seen in view of FIG. 1B, the above spacing of a distance equal to twice the diameter (2*D) between each storage cups 12 allows to fit exactly one individual storage cup 12 of a stacked multiple blister pack 1 flipped onto another between two adjacent storage cups 12 of the first pack. Although only the diameter D is referenced on FIG. 1B, it can be appreciated that the space on the blister foil 10 and the two adjacent lateral walls 122 correspond to the bottom 120 of a storage cup 12 and lateral walls 122 in an inverted position according to the blister foil's 10 axis. A stacked up arrangement of multiple blister packs 1 according to the embodiment illustrated on FIGS. 1A and 1B is shown on the following FIGS. 4A to 4C.

According to the preferred embodiment illustrated on FIGS. 1A & 1B, the storage cup's edges are surrounded by closure regions 13, which consist of a sealing area 130 onto which the closure element 4, such as e.g. a thin plastic or metal film is bonded. The corners of the two lowermost closure regions 13 are preferably rounded in order to prevent from any undesirable scratching or cutting when handling the multiple blister pack; such rounded corners are also designed for the hanging section 5 at the opposite extremity of the multiple blister pack 1.

As it can be appreciated in view of FIG. 1A, each closure regions 13 surrounding each individual storage cups 12 are mutually separated respectively by a column tearing line 2, and row tearing lines 2', so that any subset of batteries can be freely portioned, while a remaining amount of batteries is still hung through the hanging hole 11 on a rack. For multiple blister packs it is desirable to have a matrix arrangement with at least two columns in order to improve the storage capacity of each pack; yet since batteries are usually required in pairs, two can preferably be chosen as the most preferred number of columns since it is further easier to tear a row of two batteries along the same row tearing line 2' than tearing a subset of two batteries within an array having a greater number of lines and columns. Such a matrix arrangement had not been proposed so far for storing batteries, due to the size of the bar codes stretching over the whole width of the pack; employing now e.g. 2D bar codes makes it easier to reduce the space required for such marking.

According to a preferred embodiment, the column and row tearing lines (respectively 2 and 2') are rectilinear, so that they can be easily machined, e.g. through well-known cutting techniques, such as laser-cutting. The row tearing lines 2' are preferably spaced apart from a distance equal to the twice diameter D of the storage cup 12, within a tolerance of 1 millimeter, and the length L of the hanging section 5 is equal to the diameter D of the individual storage cups 12, within a tolerance of 1 millimeter, so that the extremities of piled up facing multiple blister packs 1, cannot be shifted by more of a length equal to D in the stacked position. Indeed, it can be appreciated that in an extreme case where we assume that the storage cups 12 are shifted to the left or the right in such a way that the edges 121 of each storage cups 12 extend up to the boundaries of their corresponding closure region 13, i.e. respectively their left of right row tearing line 2', then stacking up multiple blister packs in flipping the next pack with its hanging section 5 facing down the lowermost part of the previous multiple blister pack 1 would yield a lateral shift equal to exactly D, i.e. the diameter of the cell. In all cases where the center C of each storage cup 12 is not centered with respect to its left and right row tearing line 2', such a shift could hence occur with a lower value; the best case being the one illustrated by FIG. 1A where the center C of each individual storage cups 12 are equidistant from said row tearing lines 2', in which case there is no lateral shift at all and two multiple blister packs 1 can be totally superimposed onto each other, as shown on FIGS. 4 A-C described later. As a result, the storage capacity is optimized in this latter case with no additional space required lengthwise, i.e. along the columns of the multiple blister pack 1, and height requirements divided by two as compared to regular blister packs.

As shown on FIG. 1 A, the diameter D of the storage cup 12 is approximately equal to half of the overall length of each blister pack cell between two row tearing lines 2'. The diameter D is preferably equal to 13.1 millimeters, which makes up an overall sealing area 130 of 3.5 cm2 for the closure region 13; this is enough to provide a reliable bonding with the closure element 4, while providing a good trade-off in terms of surface consumption for simultaneously maximizing storage capacity. The walls of the cup 122 further preferably have a 5.4 millimeters height H.

Figure 2:
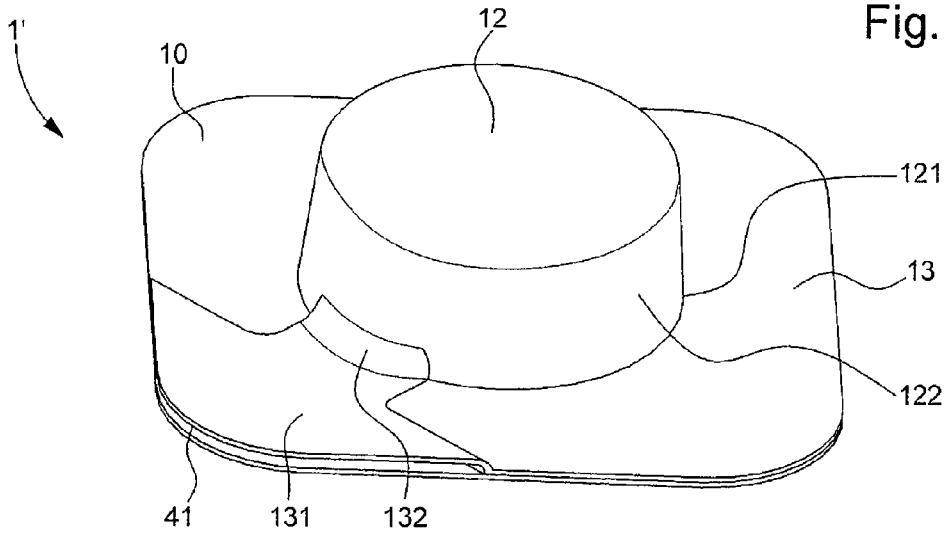
FIG. 2 shows a perspective view of a single blister pack according to a preferred embodiment of the invention.

FIG. 2 shows a perspective view of a single blister pack 1' for a button battery according to another preferred embodiment of the present invention, having a 24*24 mm size. The storage cup 12 is formed on a blister foil 10, e.g. a plastic film, by thermoforming, in order to raise lateral walls 122. The storage cup's edge 121 is surrounded by a closure region 13, whose corners are preferably rounded in order to prevent from any undesirable scratching or cutting when handling the pack. The closure region 13 is covered, on its entire area, by a closure element 4, in order to prevent the battery from dropping out when not yet opened. The closure element 4 comprises a gripping zone 41, here towards the corner of the closure element, in order to seize the closure element 4 more easily for opening it and possibly closing it again afterwards.

According to this preferred embodiment, the closure element 4 may not be a metal film, as in FIGS. 1A and 1B, but a thin plastic film of less than 100 micrometer thickness instead. This plastic film is preferably provided with a self-adhesive coating on its inner side. The closure region 13 also comprises a sealing area 130 onto which the film is bonded. As it can be appreciated in view of FIG. 2, the closure region 13 comprises an aperture zone 131 on the lower left corner, where the blister foil 10 is slightly shifted upwards, typically between 100 and 200 micrometers with respect to the plane of the sealing area 130, in order to prevent a complete sealing of the closure element 4 on the entire closure region 13 and let air flow from the inside of the storage cup 12, where the battery lies, towards the outside. This air flow, allowing for both pressure and moisture compensation, is made possible thanks to the ventilation duct 132 extending up to the storage cup's edge 121. Such a ventilation duct 132 is preferably designed as a path with reduced width inside the aperture zone 13 in order to minimize its overall surface. As a complement or an alternative to this aperture zone 13 and the ventilation duct 132, the materials used for both the blister foil 10 and the closure element 4 can be chosen with adequate porosity features, such that extreme temperature and/or pressure variations can be supported, for example during the transport of the batteries inside their blister pack.

According this illustrated preferred embodiment of the present invention, the gripping zone 41 arranged on the lower left corner is preferably deprived of any adhesive in order to avoid sticking to the fingers when manipulating the covering film making up the closure element 4. Such an adhesive-free gripping zone 41 also allows to easily position the covering film over the individual storage cup 12 with the correct angular orientation, i.e. the gripping zone 41 facing the aperture zone 130 when bonding it to the closure regions 13 again when replacing used batteries.

Figure 3:
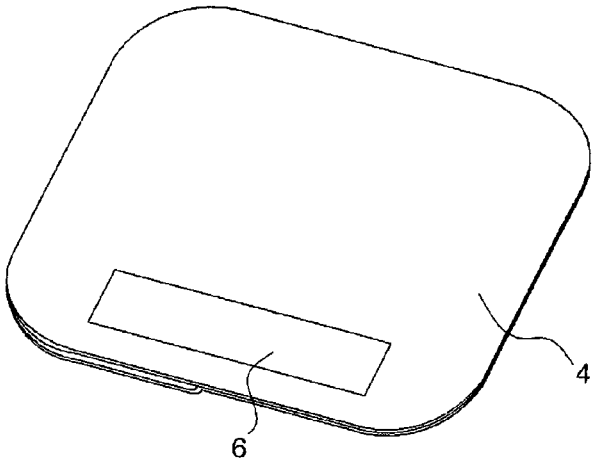
FIG. 3 shows a single blister pack according to the preferred embodiment of FIG. 2, from a rear view.

FIG. 3 shows a single blister pack according to the preferred embodiment of FIG. 2, from a rear view focusing on the closure element 4. The closure element 4 is a film sealed on the sealing area 130 of the closure region 13, and the sealed portion of this film is marked, e.g. laser-marked with tracking information concerning the battery stored in said individual storage cup, such as a battery identifier including the battery type and a serial number. Alternatively or additionally, the closure region 13 could also be marked with tracking information 6 in order to make sure that this information is still available even if the closure element 4 is completely torn out. Although the marking technique for the tracking information is preferably laser-based, other suitable techniques such as etching technique could be employed, bearing in mind that they should be as cost effective as possible.

For producing multiple blister packs as illustrated on FIG. 1A or FIG. 1B, it is necessary to mark button batteries with their respective tracking information 6, which allows to identify them, and then marking each closure element 4 and/or closure regions 13 with the same identifiers, preferably after the closure element is bonded to the closure region 13.

For embodiments using thin metal films instead of reusable plastic film provided with a self-adhesive coating, preferably no part of the closure element 4 that is not sealed to the sealing area 130 will be used for tracking purposes since this part is severely damaged when torn apart for letting the button batteries through for removal. Instead, the tracking information 6 will preferably be imprinted directly onto the sealing area 130, or even within the blister foil 10.

Figure 4C:
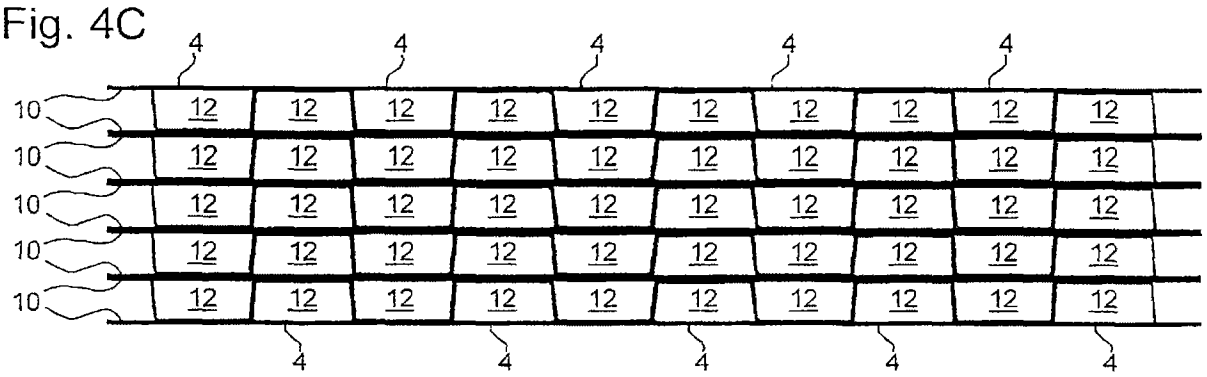
FIGS. 4 A,B, and C show a stack of multiple blister packs according to the preferred embodiment of FIGS. 1A and 1B, respectively from a top/bottom view, length side view, and width side view.
Figure 4A:
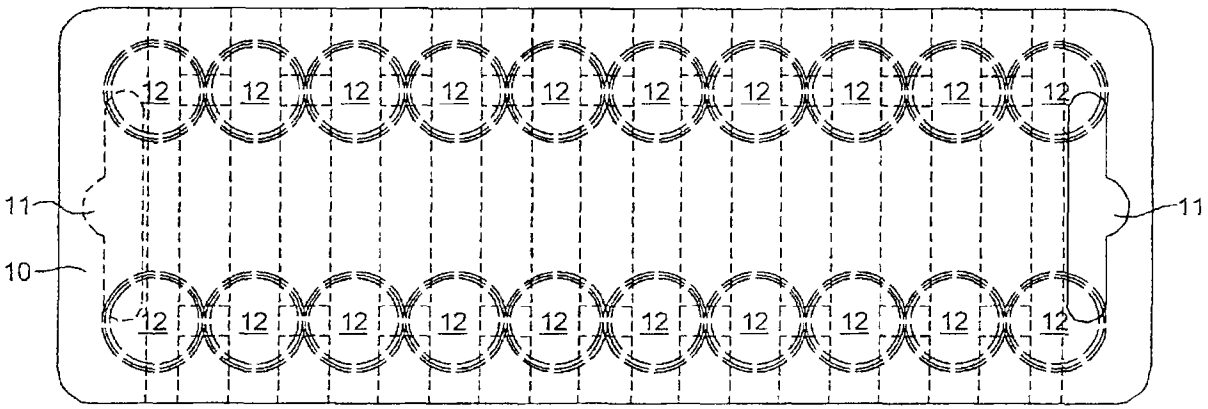
Figure 4B:
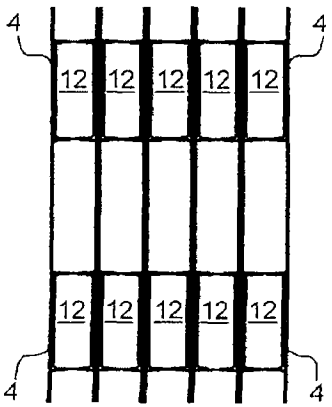

FIGS. 4 A,B, and C show respectively a stack of multiple blister packs 1 according to the preferred embodiment of FIGS. 1A and 1B, where the spacing between the centers C of each storage cup 12 are twice the diameter (2*D) of each storage cup 12, the length L of the hanging section 5 is equal to the diameter D and the centers C are centered between two row tearing lines 2', spaced of a distance equal to twice the diameter (2*D) of each storage cup 12 also. FIG. 4A is a top/bottom view, whereas FIG. 4B is a length side view, and FIG. 4C is a width side view.

FIG. 4A shows two columns of 10 adjacent button batteries, wherein two hanging holes 11 can be seen at each opposite end of the stack. This shows that the multiple blister packs 1 are grouped by pairs, wherein one multiple blister pack 1 is flipped onto another in such a way that the leftmost rows of the flipped multiple blister pack fit into the space left free by the hanging section 5, and wherein all other rows of button batteries are spaced apart from a lateral distance D, so that they can be interlocked. As it can be seen on FIG. 4B, the stack preferably comprises five pairs of multiple blister packs 1, so that a round number of 100 batteries can be wrapped up in the same box having roughly the dimensions of the same length and width of each multiple blister pack 1, and an overall height equal to roughly 5 times the height H of each multiple blister pack 1 added up to only 5 times the thickness of each blister foil 10. As a result, the storage space for the batteries is dramatically reduced, since the thickness of each blister foil 10 is usually less than ten times thinner as compared to the overall height H of the blister pack 1 including the storage cups 12, typically 0.3 as compared to 5.4 millimeters. Closure elements 4 of only the leftmost and rightmost multiple blister packs 1 are shown.

FIG. 4C shows the same 100 batteries pack as on FIG. 4B, wherein the slight slope of each lateral walls 122 of the respective storage cups 12 are illustrated. According to a preferred embodiment of the present invention, the storage cup's walls 122 are inclined of an angle comprised between 4 and 6 degrees, and according to the preferred embodiment shown on FIG. 4B, this angle is equal to 5.3 degrees. Such an inclination angle allows, on the one hand, to easily hold the battery in place through a pinching of the usually completely vertical lateral walls of the button battery by the inclined lateral walls 122 of each storage cup 12, and also allows, on the other hand, to fit the storage cups 12 of two facing multiple blister packs 1 between each other more easily without damaging or compressing the lateral walls 122 of the respective storage cups 12 of each multiple blister pack 1. Only the lowest closure elements 4 of the lowermost multiple blister pack 1 are shown below the storage cups 12 while the uppermost closure elements of the uppermost multiple blister pack 1 are shown above the highest storage cups 12.

It can be appreciated in view of this FIG. 4C that the stack of 10 blister packs consists of a pile of 5 pairs of 2 blister packs, wherein each blister pack is flipped onto another in such a way that their respective hanging sections 5 are upside down, i.e. the hanging section 11 of one blister pack lying over the ending rounded section of another, and that rows of individual storage cups 12 are interlocked. As a result, the overall height of each pair is equal to twice the thickness of the blister foil 10 plus the height H of the individual storage cups 12, which of course dramatically minimizes the overall height of the stack.

According to a preferred embodiment according the present invention, the multiple blister packs may be further improved, as far as the recycling process of the batteries and their packaging is concerned, in choosing materials for the blister foil 10 of the pack and the closure elements 4 that are biodegradable, such as corn starch. This would dispense with packaging waste treatment once the defective or used batteries have been collected.

| References list | |
|---|---|
| 1 | Multiple blister pack |
| 1' | Single blister pack |
| 10 | Blister foil |
| 11 | Hanging hole |
| 12 | Individual storage cup |
| 120 | Cup's bottom |
| 121 | Cup's edge |
| 122 | Cup's wall |
| 13 | Closure regions (for bonding/sealing etc) |
| 130 | Sealing area |
| 131 | Aperture zone |
| 132 | Ventilation duct |
| 2 | Column tearing line |
| 2' | Row tearing line |
| 4 | Closure element (cover film) |
| 5 | Hanging section |
| 6 | Tracking information |
| A | Inclination angle |
| C | Storage cup's center |
| D | Diameter of the storage cups 120 |
| H | Storage cup's height |
| L | Length of the hanging section |

What is claimed is:

1. A multiple blister pack for button batteries comprising:

a blister foil designed to provide individual storage cups each including a center and a diameter, each individual storage cup receiving one of the button batteries; and individual closure regions for each said individual storage cup, wherein each said individual closure region receives a closure element, wherein said individual storage cups are arranged on said blister foil according to a matrix pattern with at least two columns, wherein each closure region surrounding each individual storage cup is mutually separated by column and row tearing lines, wherein at least one of said closure element or said closure region is provided with tracking information identifying one of the button batteries to be stored in said individual storage cup, the tracking information distinguishing the one of the button batteries from another one or more of the button batteries, and the centers of said individual storage cups are spaced apart a distance equal to twice the diameter of said individual storage cup from each other along each column of said matrix, within a tolerance of 1 millimeter, and wherein at least one of the closure regions includes an aperture zone in which the blister foil is shifted upwards with respect to a plane of a sealing area, and a ventilation duct is formed between the aperture zone and an edge of one of the individual storage cups to permit an air flow from an inside of the one of the individual storage cups to an outside of the one of the individual storage cups.

2. The multiple blister pack according to claim 1, wherein the row tearing lines are rectilinear and spaced apart a distance equal to twice said diameter of said individual storage cups, within a tolerance of 1 millimeter, and wherein said multiple blister pack comprises a hanging section, wherein a length of said hanging section is equal to the diameter of said individual storage cups, within a tolerance of 1 millimeter.

3. The multiple blister pack according to claim 2, wherein said centers of said individual storage cups are equidistant from said row tearing lines.

4. The multiple blister pack according to claim 3, wherein the individual storage cup's walls are inclined at an angle between 4 and 6 degrees with respect to a vertical direction.

5. The multiple blister pack according claim 4, wherein said closure element is a film and wherein said closure region is the sealing area for said closure element, and wherein a sealed portion of at least one of said closure element or said closure region is laser-marked with the tracking information identifying the one of the button batteries stored in said individual storage cup.

6. The multiple blister pack according to claim 1, wherein both said blister foil and said closure elements are made of a biodegradable material.

7. A method for storing button batteries into the multiple blister pack according to claim 1, the method comprising:

marking the button batteries with the respective tracking information;

thermoforming the blister foil so as to provide the matrix of the individual storage cups each including the center and the diameter and each receiving one of the button batteries, wherein said matrix comprises at least two rows and the centers of said individual storage cups are spaced apart the distance equal to twice the diameter of said individual storage cup from each other along each column of said matrix, within the tolerance of 1 millimeter;

placing said button batteries into the individual storage cups;

bonding the closure elements on the closure regions surrounding said individual storage cups;

realizing the column and row tearing lines around each closure region surrounding each individual storage cup; and marking each said closure elements and/or said closure regions with said respective tracking information of said button batteries.

8. The method for storing button batteries into the multiple blister pack according to claim 7, the method further comprising:

grouping more than one of the multiple blister pack by pairs, wherein each blister pack is flipped onto another in such a way that their respective hanging sections are upside down and that the rows of the individual storage cups are interlocked.

9. The multiple blister pack according to claim 1, wherein the tracking information distinguishes the one of the button batteries from all other button batteries.

* * * * *